US007628098B2

(12) United States Patent
Kimberly

(10) Patent No.: US 7,628,098 B2
(45) Date of Patent: Dec. 8, 2009

(54) REMOTE OPERATED CLOSED-END WRENCH

(76) Inventor: Anthony Joseph Kimberly, 1308 W. 20th St., Lawrence, KS (US) 66046

( * ) Notice: Subject to any disclaimer, the term of this patent is extended or adjusted under 35 U.S.C. 154(b) by 0 days.

(21) Appl. No.: 12/244,937

(22) Filed: Oct. 3, 2008

(65) Prior Publication Data

US 2009/0090220 A1 Apr. 9, 2009

Related U.S. Application Data

(60) Provisional application No. 60/997,494, filed on Oct. 3, 2007.

(51) Int. Cl.
*B25B 17/00* (2006.01)
*B25B 21/00* (2006.01)

(52) U.S. Cl. ..... 81/57.29; 81/57.13

(58) Field of Classification Search ..... 81/57.29, 81/57.13, 185, 169, 170, 57.28, 57.12
See application file for complete search history.

(56) References Cited

U.S. PATENT DOCUMENTS

| | | | | | |
|---|---|---|---|---|---|
| 858,892 | A * | 7/1907 | Moss | ..... | 81/57.29 |
| 4,003,275 | A * | 1/1977 | Smith | ..... | 81/57.29 |
| 4,545,267 | A | 10/1985 | Shumway | | |
| 5,058,463 | A | 10/1991 | Wannop | | |
| 5,345,845 | A * | 9/1994 | Myers | ..... | 81/57.29 |
| 5,630,343 | A * | 5/1997 | Begin | ..... | 81/57.29 |
| 6,457,386 | B1 | 10/2002 | Chiang | | |
| 6,536,310 | B2 * | 3/2003 | Goldfein | ..... | 81/57.29 |
| 7,089,827 | B2 * | 8/2006 | Wexler | ..... | 81/57.29 |
| 7,181,996 | B1 * | 2/2007 | Chu | ..... | 81/57.29 |
| 2003/0172780 | A1 * | 9/2003 | Newell | ..... | 81/57.29 |

* cited by examiner

*Primary Examiner*—Hadi Shakeri
(74) *Attorney, Agent, or Firm*—Hovey Williams LLP

(57) ABSTRACT

A powered wrench is configured to rotate fasteners and includes a drive and a closed-end wrench. The closed-end wrench includes a wrench case, a socket rotatably mounted in the case, and a driveshaft rotatably mounted in the case and attached to the drive. The driveshaft includes a worm gear drivingly connected to a toothed external face of the socket so that rotation of the driveshaft by the pneumatic drive causes rotation of the socket.

11 Claims, 4 Drawing Sheets

REMOTE OPERATED CLOSED-END WRENCH

RELATED APPLICATION

This application claims the benefit of U.S. Provisional Application Ser. No. 60/997,494, filed Oct. 3, 2007, entitled REMOTE OPERATED CLOSED-END WRENCH, which is hereby incorporated in its entirety by reference herein.

BACKGROUND

1. Field

The present invention relates generally to wrenches. More specifically, embodiments of the present invention concern a shaft-driven closed-end wrench.

2. Discussion of Prior Art

Many types of wrenches are used to rotate threaded fasteners. The most basic type of wrench is a hand wrench having a handle and at least one open or closed wrench end fixed to the handle. A ratchet wrench also includes a handle and a head and further includes a socket rotatably attached to the head, with a pawl that restricts socket rotation relative to the head in one rotational direction. One type of ratchet wrench includes a closed end head and a socket supported in the head, with the socket having an outer surface that engages a pawl. Yet another type of wrench with a rotatable socket is a powered socket wrench that includes a motor attached to the wrench head and drivingly attached to the socket to rotate the socket when the motor is turned on by a user.

Prior art wrenches are problematic and suffer from various limitations. For instance, prior art wrenches are difficult to use in tight spaces. Prior art wrenches, such as hand and ratchet wrenches, require significant open space in a radial direction from the fastener to permit the user to swing the wrench back and forth about the fastener rotation axis for rotating the socket. Prior art wrenches, particularly socket wrenches, also require open space in an axial direction from the fastener to permit the wrench to be slipped into and out of engagement with the fastener head.

SUMMARY

Embodiments of the present invention provide a closed-end wrench that does not suffer from the problems and limitations of the prior art wrenches set forth above.

A first aspect of the present invention concerns a powered wrench broadly including an elongated body, a rotatable driveshaft, a head, and a socket. The rotatable driveshaft extends along the body. The head is adjacent one end of the body. The socket is supported by the head for rotation about a rotational axis. The socket presents axially spaced opposite ends and radially spaced internal and external faces. The external face is toothed and drivingly connected to the driveshaft so that rotation of the driveshaft effects rotation of the socket. The internal face is polygonal in shape and configured to engage a correspondingly sized fastener. The internal face defines an axially extending pass-through opening defined continuously from one socket end to the other.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 1:
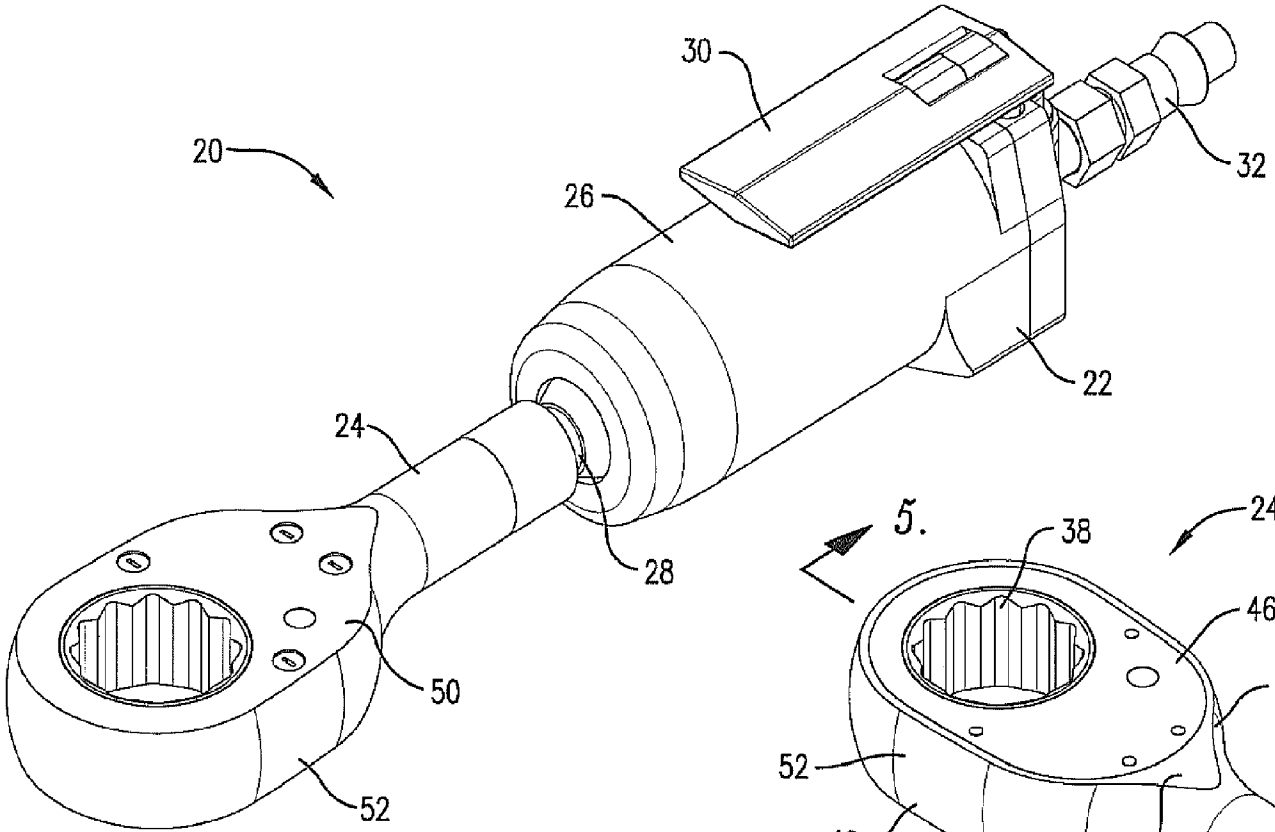
FIG. 1 is an upper perspective of a powered wrench constructed in accordance with a first embodiment of the present invention, and showing a pneumatic motor and a closed-end wrench of the powered wrench.
Figure 2:
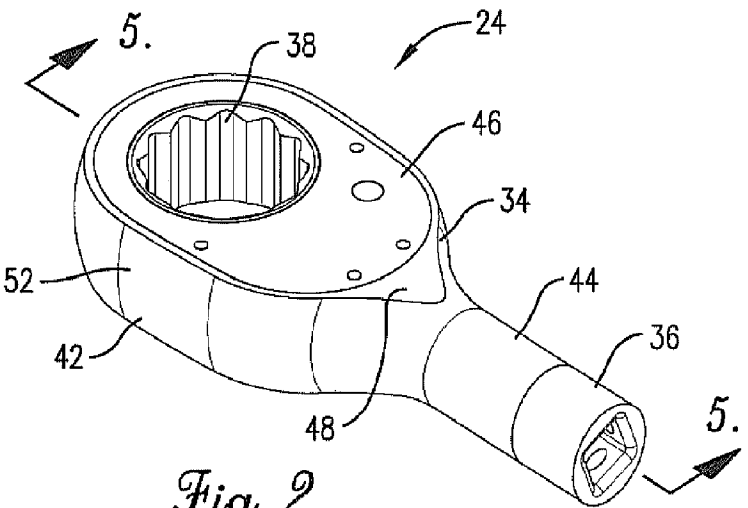
FIG. 2 is a lower perspective of the closed-end wrench shown in FIG. 1, showing a wrench case with a head, handle, and a cover, with a driveshaft and a socket mounted in the wrench case.
Figure 4:
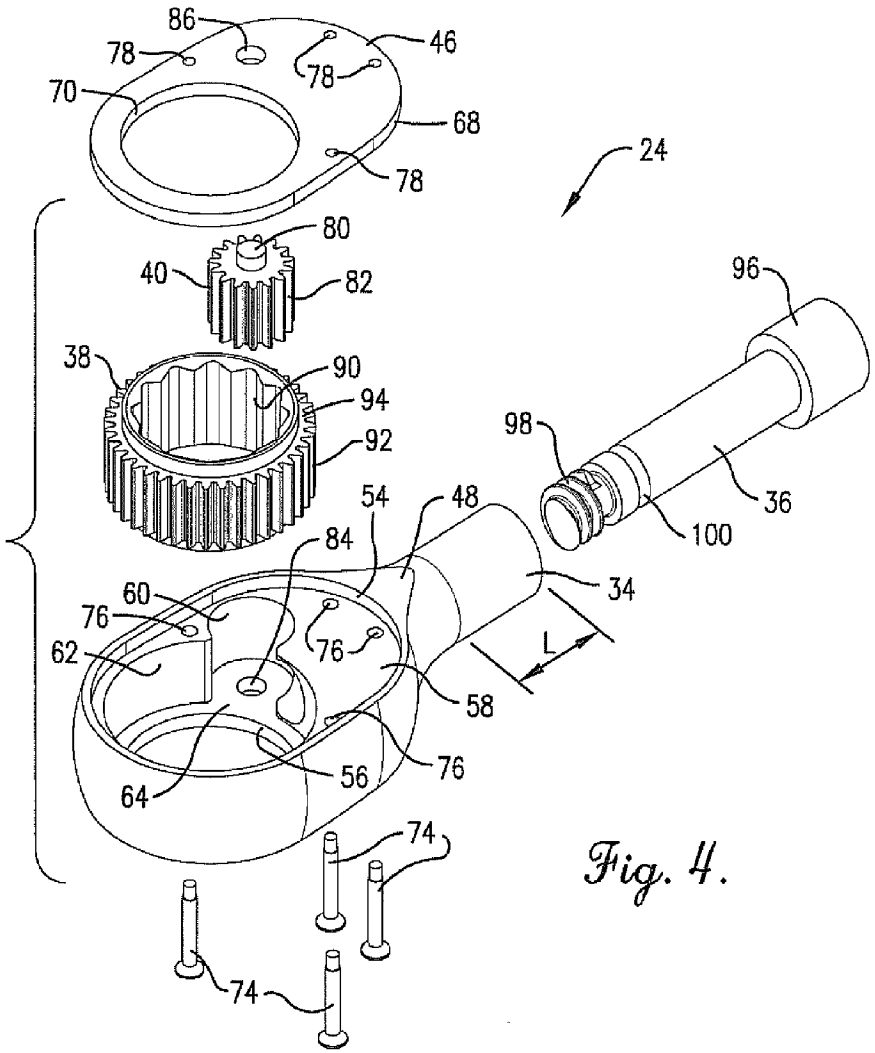
FIG. 4 is an exploded view of the closed-end wrench shown in FIGS. 1-3, showing the cover and case fasteners exploded from the head, and also showing the driveshaft, spur gear, and socket exploded from the wrench case.
Figure 3:
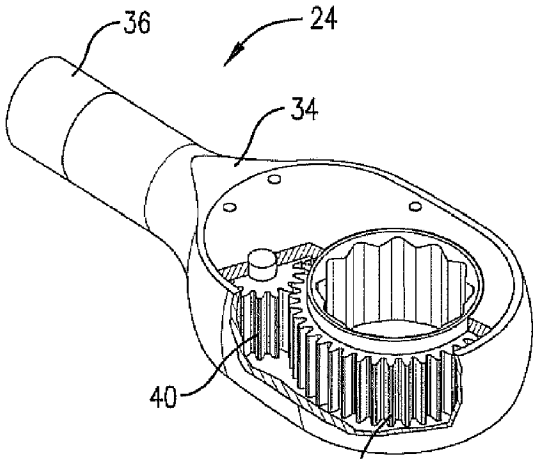
FIG. 3 is a lower perspective of the closed-end wrench shown in FIGS. 1 and 2, showing parts of the head and cover broken away to show the socket and a spur gear of the wrench.
Figure 5:
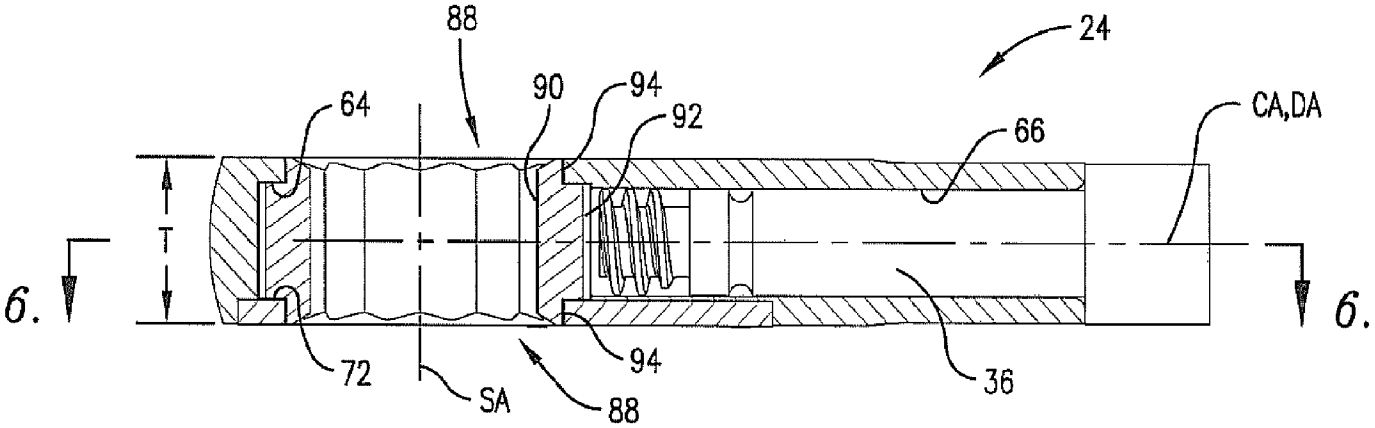
FIG. 5 is a cross-section of the closed-end wrench taken along line 5-5 in FIG. 2, showing the drive shaft and the socket positioned symmetrically relative to a driveshaft axis.
Figure 6:
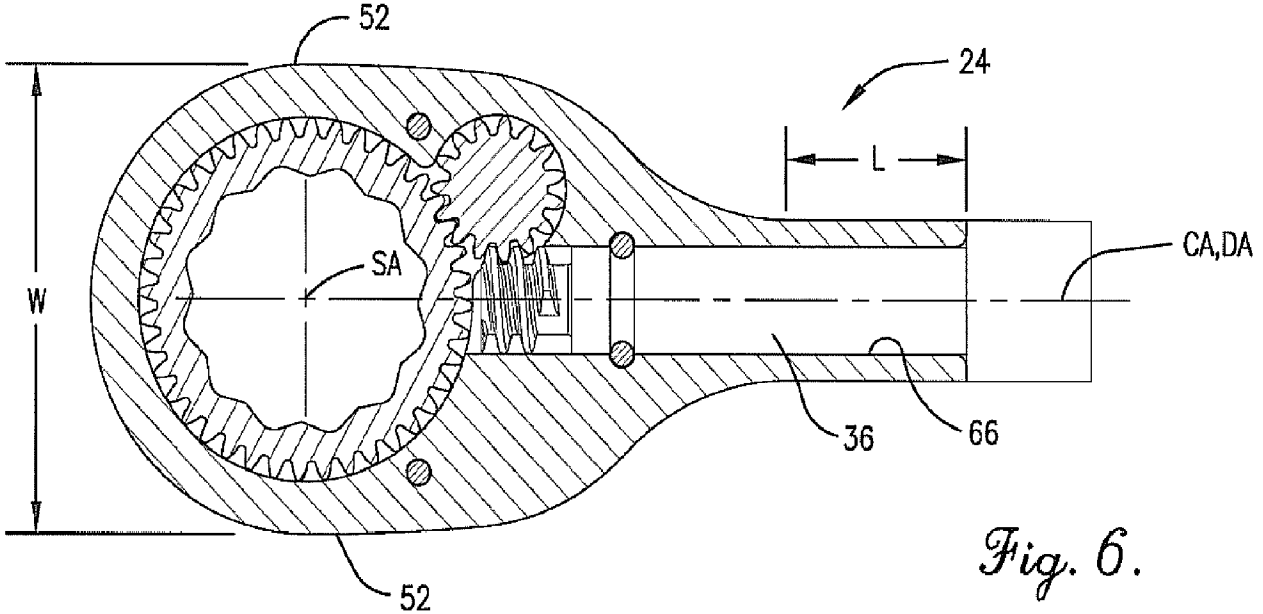
FIG. 6 is a cross-section of the closed-end wrench taken along line 6-6 in FIG. 5, showing the drive shaft, spur gear, and socket in driving engagement with each other, with the driveshaft axis intersecting a socket axis.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIG. 1, a powered wrench 20 serves as a tool to rotate, e.g., to tighten and loosen, fasteners (not shown). The illustrated powered wrench 20 is particularly useful for rotating a fastener in a cramped space that permits little or no wrench movement. However, the principles of the present invention are equally applicable where the powered wrench 20 is configured for use as another type of rotating tool, e.g., a powered screwdriver, grinder, polisher, drill, or cutting tool. The powered wrench 20 broadly includes a pneumatic drive 22 and a closed-end wrench 24.

The pneumatic drive 22 is conventional and includes a housing 26, an air motor (not shown) received within the housing 26, an output shaft 28, a motor-engaging lever 30, and an air inlet coupler 32. In the usual manner, the pneumatic drive 22 is fluidly connected to a compressed air supply, i.e., by attaching an air supply line to the air inlet coupler 32. The pneumatic drive 22 is operated by depressing the lever 30 to allow compressed air to spin the motor and thereby rotate the output shaft 28. While the illustrated drive 22 is preferable, it is consistent with the principles of the present invention where the pneumatic drive 22 is alternatively constructed. Furthermore, another type of powered drive, such as an electric motor, could be used to power the closed-end wrench 24. However, it is also within the scope of the present invention where the drive 22 is not motorized. For example, the drive 22 could comprise a hand-driven lever, such as a hand ratchet, operable to drive the wrench 24.

Turning to FIGS. 1-6, the closed-end wrench 24 is configured to be powered by the pneumatic drive 22 to rotate fasteners in a confined space. The closed-end wrench 24 broadly includes a wrench case 34, a driveshaft 36, a rotatable socket 38, and a spur gear 40 drivingly interconnecting the driveshaft 36 and the socket 38.

The wrench case 34 is configured to house the driveshaft 36, socket 38, and spur gear 40, as will be discussed in greater detail. The wrench case 34 includes a head 42, a handle 44, and a cover 46. The head 42 presents oppositely spaced outer face surfaces 48,50 that are substantially parallel to each other and define a thickness T of the head 42 (see FIG. 5). The head 42 also presents outer side surfaces 52 that define a width W of the head 42, with the thickness T being less than about half the width W. However, it is also within the scope of the present invention where the head 42 has a thickness T and width W with alternative dimensions, e.g., where the thickness T is greater than half the width W.

The head 42 further presents opposite openings 54,56 that intersect respective face surfaces 48,50. The opening 54 extends from the face surface 48 to a retaining surface 58 to present a space for receiving the cover 46. The head 42 also presents spur and socket radial bearing surfaces 60,62 that extend from the retaining surface 58 to an axial bearing surface 64. The opening 56 extends from the axial bearing surface 64 to the face surface 50. The bearing surfaces 60,62,64 partly form a chamber that is operable to receive the socket 38 and spur gear 40. In particular, the bearing surfaces 60,62 define corresponding chamber portions, with the chamber portions intersecting to permit driving engagement of the socket 38 and spur gear 40 as will be discussed further.

The handle 44 is generally cylindrical in shape and presents spaced apart proximal and distal ends. The handle 44 also presents a handle diameter that is constant along the length L of the handle 44 and is substantially equal to the thickness T of the head 42. However, the illustrated handle 44 could present an alternative shape without departing from the scope of the present invention. For example, the handle 44 could present an alternative cross sectional shape, e.g., a square or hexagonal shape instead of a circular shape. Also, the handle diameter could be larger or smaller than the head thickness T, or the handle diameter could vary along the handle length to present a contoured handle shape. Furthermore, the handle 44 could present an alternative handle length L, as will be shown in a subsequent embodiment.

The distal end of the handle 44 is attached to the head 42, with the illustrated head 42 and handle 44 being integrally formed to present a substantially rigid construction. However, it is also within the scope of the present invention where the head 42 and handle 44 are shiftably attached to each other. For instance, the head 42 could be pivotally attached to the handle 44 about an axis transverse to the length of the handle 44 to permit selective angular positioning of the head 42 relative to the handle.

The head 42 and handle 44 also cooperatively present a bore 66 that extends continuously from the proximal end of the handle 44 to the distal end and extends axially into the head 42 to intersect the chamber of the head 42. The head 42 and handle 44 are symmetrically aligned along a case axis CA, with the outer face surfaces 48,50 and outer side surfaces 52 being symmetrically positioned relative to the case axis CA (see FIGS. 5 and 6). Furthermore, the case axis CA is substantially coaxial with the bore 66 and intersects an axis of the socket radial bearing surface 62 at a perpendicular angle. In this manner, the wrench case 34 is configured to position the driveshaft 36 and socket 38 so that an axis DA of the driveshaft 36 and an axis SA of the socket 38 intersect each other. This configuration preferably gives the closed-end wrench 24 a generally flat wrench profile along the length thereof to thereby enable positioning of the wrench 24 in cramped spaces. However, the head 42 and handle 44 could be alternatively configured without departing from the scope of the present invention. For instance, the head 42 and handle 44 could have distinct axes that are offset to define an oblique angle therebetween.

The cover 46 comprises a unitary plate with an outermost oval-shaped edge 68 and an opening 70. The cover 46 further presents an axial bearing surface 72 adjacent the opening 70. The cover 46 is removably received within the opening 54 and secured therein by a plurality of fasteners 74 that extend through corresponding holes 76 in the head 42 and are attached to threaded holes 78 in the cover 46. However, the cover 46 could be attached to the head 42 using other types of fasteners or another attachment mechanism without departing from the scope of the present invention. With the cover 46 installed in the head 42, the openings 56,70 are coaxially aligned and further aligned with the axis of the socket radial bear surface 62. Furthermore, the illustrated axial bearing surfaces 64,72 are opposed to each other to retain the socket 38.

The spur gear 40 is conventional and includes a shaft 80 and a gear 82 mounted on the shaft 80. The gear 82 presents a gear face that defines a plurality of gear teeth uniformly spaced about the shaft 80. While the illustrated shape of the spur gear 40 is preferable, the spur gear 40 could be alternatively configured without departing from the scope of the present invention. For example, the illustrated gear teeth are preferably straight, but could be angled so that the gear 82 comprises a helical gear. The spur gear 40 is rotatably mounted in the chamber by inserting corresponding ends of the shaft 80 into holes 84,86 presented by the head 42 and cover 46, respectively.

The socket 38 comprises a unitary ring that presents opposite socket ends 88, a corrugated internal face 90 extending between the ends 88, and a toothed external face 92 extending between the ends 86, with the socket 38 defining a socket axis. The internal face 90 defines a polygonal-shaped opening with an innermost diameter that extends completely through the socket 38 to permit a fastener (not shown) to pass through the socket 38. However, it is also within the ambit of the present invention where one of the socket ends 88 is closed. The illustrated opening defines a polygon having twenty-four (24) sides so that the socket 38 comprises a 12-point socket. However, the principles of the present invention are applicable where the socket 38 is a 4-point, 6-point, or 8-point socket. Furthermore, it is within the ambit of the present invention where the socket 38 does not include the internal face 90, but includes another rotatable tool feature. For example, the socket 38 could include a male fastener-driving bit (such as a screwdriver or hex bit), a shaping bit (such as a bur bit, grinding bit, or polishing bit), a drill bit (such as an auger bit), or a cutting bit.

The illustrated external face 92 includes a plurality of gear teeth spaced uniformly about the socket axis SA to define a spur gear with an outermost diameter. While the illustrated teeth are preferably straight, it is also within the scope of the present invention where the teeth are angled to define a helical gear. The external face 92 also preferably presents circumferential grooves 94 spaced on opposite sides of the gear teeth that define opposite ends of the teeth. The socket 38 is rotatably mounted in the chamber by inserting corresponding socket ends 88 into the openings 56,70, with the axial bearing surfaces 64,72 slidably engaging respective ends of the gear teeth. In this manner, the bearing surfaces 64,72 retain the socket 38 within the chamber during rotational movement of the socket 38. Furthermore, the gear teeth of socket 38 intermesh with gear teeth of the spur gear 40 so that socket 38 and spur gear 40 drivingly engage each other. Preferably, the spur gear 40 presents an outermost spur diameter smaller than the outermost diameter dimension of the socket 38 to provide a gear reduction, but the socket 38 and spur gear 40 could be alternatively configured without departing from the scope of the present invention.

While the illustrated wrench 24 includes the single socket 38, it is within the scope of the present invention for the wrench 24 to have one or more additional sockets that can be selectively interchanged with the illustrated socket 38. For instance, one or more interchangeable sockets could include different innermost diameter dimensions to drivingly engage corresponding fastener sizes, as will be discussed in a subsequent embodiment. The one or more interchangeable sockets would also preferably present the same outermost diameter dimension as the socket 38 to drivingly engage the spur gear 40 when installed in the head 42. However, the wrench 24 could be alternatively configured to provide interchangeability of sockets.

The driveshaft 36 is elongated and includes a coupler 96 and a worm gear 98 at corresponding proximal and distal ends of the driveshaft 36. The coupler 94 presents a square opening that is operable to removably receive a square end of output shaft 28. The illustrated worm gear 98 comprises a single-thread worm. The driveshaft 36 is rotatably received in the bore 66, and the driveshaft 36 is held in the bore 66 by engaging one of the fasteners with an annular groove 100 presented by the driveshaft 36. Furthermore, the driveshaft axis DA is preferably coaxial to the case axis CA, but it is also within the scope of the present invention where the driveshaft 36 is offset from the case axis CA. The driveshaft 36 is positioned with the worm gear 98 in intermeshing engagement with the spur gear 40. As the driveshaft 36 is rotated about the driveshaft axis DA, the worm gear 96 rotates the spur gear 40, with the spur gear 40 rotating the socket 38. As will be shown in subsequent embodiments, the wrench 24 could include an alternative gear arrangement.

While the illustrated driveshaft 36 is substantially unitary and rigid, the principles of the present invention are applicable where the driveshaft 36 has an alternative configuration. For instance, the driveshaft 36 could include a universal joint to permit relative pivoting movement between the proximal and distal ends, e.g., to permit pivoting of the head 42 relative to the handle 44.

The illustrated driveshaft 36 is positioned generally inline with the socket 38 to present a flat wrench profile. In particular, driveshaft axis DA (and the coaxial case axis CA) preferably intersects the socket 38, with the driveshaft axis DA intersecting the socket axis SA at a substantially perpendicular angle. In other words, the driveshaft axis DA preferably lies in a plane perpendicular to the socket axis SA, with the plane bisecting the socket 38. Therefore, the socket 38 and driveshaft 36 are symmetrically positioned relative to the driveshaft axis DA. However, the socket 38 and driveshaft 36 could be alternatively positioned relative to each other without departing from the scope of the present invention. For instance, the driveshaft axis DA could intersect the socket axis SA at an oblique angle.

In operation, the powered wrench 20 can be used by an operator in a variety of positions to tighten or loosen rotatable fasteners. In particular, the powered wrench 20 is particularly effective for rotating a fastener in a cramped space that permits little or no wrench movement. For example, the wrench 20 can be slipped onto the head of a fastener, e.g., a bolt head, by moving the wrench 20 so that the socket internal face 90 is aligned with the bolt head, and then moving the wrench 20 axially to fit the socket 38 around the bolt head and into driving engagement. The fastener can then be rotated by depressing the lever 30 to rotate the socket 38 in either rotational direction about the socket axis SA. The wrench 20 can then be removed from the bolt head by shifting the wrench 20 axially away from the bolt head, thereby disengaging the wrench 20 from the bolt head.

Figure 7:
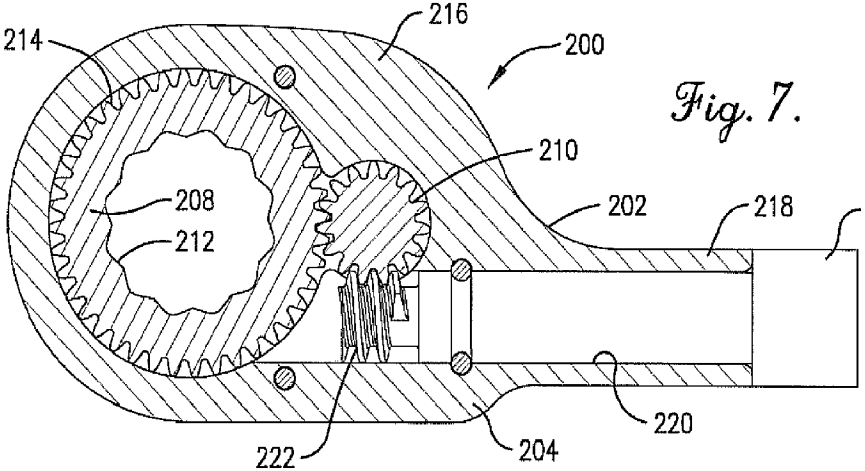
FIG. 7 is a cross-section of a closed-end wrench constructed in accordance with a second embodiment of the present invention.
Figure 8:
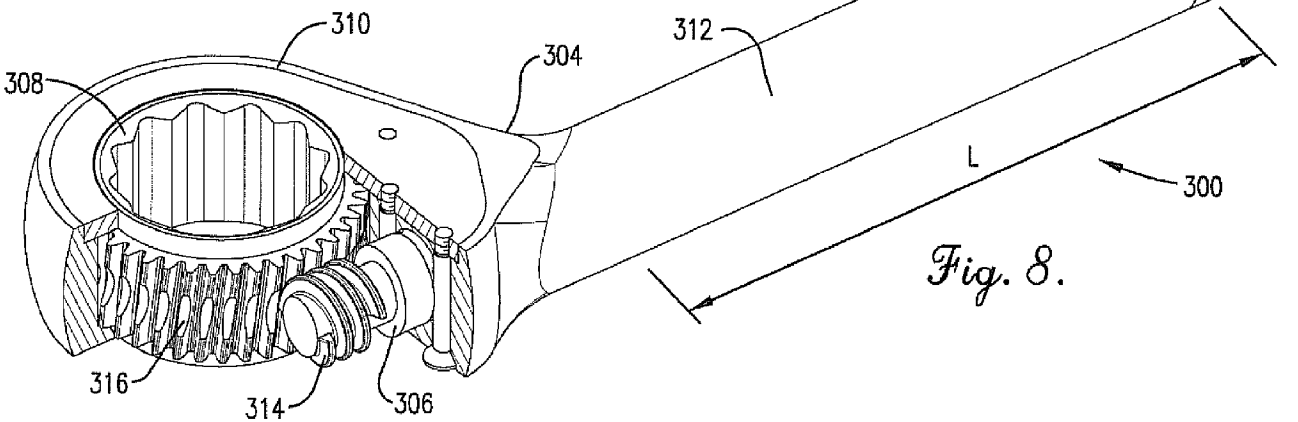
FIG. 8 is a fragmentary perspective of a closed-end wrench constructed in accordance with a third embodiment of the present invention, showing part of the head and cover broken away to show the socket and drive shaft in intermeshing engagement.

Turning to FIGS. 7 and 8, alternative preferred embodiments of the present invention are depicted. For the sake of brevity, the remaining description will focus primarily on the differences of these alternative embodiments from the preferred embodiment described above.

Initially turning to FIG. 7, an alternative powered wrench 200 is constructed in accordance with a second embodiment of the present invention. The alternative powered wrench 200 includes an alternative closed-end wrench 202 with an alternative wrench case 204, a driveshaft 206, an alternative rotatable socket 208, and a spur gear 210. The alternative socket 208 presents an internal face 212 with an innermost diameter dimension smaller than the innermost diameter of the internal face 90 depicted in the first-mentioned embodiment. Thus, the illustrated socket 208 is configured to engage a smaller fastener than the socket 38. However, the socket 208 presents an external face 214 having an outermost diameter dimension substantially the same size as the outermost diameter of the external face 92. Thus, the illustrated wrench 202 permits interchanging of various socket sizes to engage variously sized fasteners.

The wrench case 204 includes a head 216 and a handle 218 that cooperatively present a bore 220 that rotatably receives the driveshaft 206. The head 216 and handle 218 are also offset from each other so that the socket axis and the driveshaft axis are offset and do not intersect. By offsetting the driveshaft 206 relative to the socket 208, the illustrated arrangement of driveshaft 206, socket 208, and spur gear 210 results in the spur gear 210 being centrally positioned along the axial length of the worm gear 222.

Turning to FIG. 8, an alternative power wrench 300 is constructed in accordance with a third embodiment of the present invention. The alternative powered wrench 300 includes an alternative closed-end wrench 302 with an alternative wrench case 304, an alternative driveshaft 306, and a rotatable socket 308.

The wrench case 304 includes a head 310 and a handle 312 that cooperatively present a bore that rotatably receives the driveshaft 306. The handle 312 presents an alternative length L more than twice as long as the length of handle 44 depicted in the first-mentioned embodiment. The head 310 and handle 312 are also offset from each other so that the socket axis SA and the driveshaft axis DA are offset and do not intersect. Furthermore, the illustrated driveshaft 306 includes a worm gear 314 that directly engages a toothed external face 316 of the socket 308.

The toothed external face 316 includes a plurality of gear teeth spaced about the socket axis SA. Furthermore, the gear teeth are angled relative to an upright direction parallel to the socket axis SA so that the gear teeth cooperatively form a helical gear. In addition, the illustrated worm gear 314 comprises a two-thread worm configured to engage the helical gear teeth of the socket 308.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A powered wrench comprising:

an elongated body presenting a distal end;

a rotatable driveshaft extending along the body;

a head adjacent the distal end of the body;

a geared socket supported by the head for rotation about a rotational socket axis, said socket presenting axially spaced opposite socket ends and radially spaced internal and external faces, said internal face being polygonal in shape and configured to engage a correspondingly sized fastener, said internal face defining an axially extending pass-through opening defined continuously from one socket end to the other, said external face being toothed and facing in a radially outward direction so that the geared socket comprises a toothed gear, said driveshaft including, a distal helical-toothed input gear that presents a helical tooth and a shaft axis about which the input gear rotates, with the shaft axis intersecting the rotational socket axis so that the input gear is centrally positioned relative to the socket;

an intermediate toothed gear that intermeshes with the external face and the helical tooth of the input gear and thereby drivingly interconnects the geared socket and driveshaft; and a shaft-engaging bearing element secured to the head and slidably engaging the driveshaft at a bearing location on the drive shaft to restrict axial sliding movement of the drive shaft along the shaft axis, said input gear spaced distally from the bearing element and adjacent the socket, with the drive shaft being devoid of another bearing location distal to the input gear and thereby permitting the input gear to be positioned adjacent the socket, said bearing location on the driveshaft comprising an endless annular groove adjacent the input gear, said groove slidably receiving the bearing element, with the groove and bearing element cooperatively restricting axial sliding movement of the drive shaft, said bearing element comprising a pair of shaft-engaging fasteners removably secured to the head and positioned on opposite sides of the shaft axis, said head including a removable cover that releasably secures the socket within the head, wherein said shaft-engaging fasteners engage threaded holes securing said cover to said head.

2. The powered wrench as claimed in claim 1; and a power source, said driveshaft being connected to said power source adjacent a proximal end thereof.

3. The powered wrench as claimed in claim 2, said proximal end of the driveshaft including a coupler removably connected to the power source.

4. The powered wrench as claimed in claim 2, said power source comprising a pneumatic motor.

5. The powered wrench as claimed in claim 1, said driveshaft being located substantially within the body, said body presenting a longitudinal body axis, said body axis being generally perpendicular to the rotational axis of the socket.

6. The powered wrench as claimed in claim 5, said body axis being disposed in a plane that intersects the socket.

7. The powered wrench as claimed in claim 6, said opposite socket ends being spaced equally from the plane such that the plane bisects the socket.

8. The powered wrench as claimed in claim 6, said driveshaft being coaxial with the body axis.

9. The powered wrench as claimed in claim 8, said body axis intersecting the rotational axis of the socket.

10. The powered wrench as claimed in claim 1, said intermediate toothed gear being smaller in diameter than the socket.

11. The powered wrench as claimed in claim 1, said input gear comprising a worm gear with at least one worm, said intermediate toothed gear and said geared socket comprising intermeshing spur gears, with the at least one worm drivingly engaging the intermediate toothed gear.

* * * * *